US009259836B2

(12) United States Patent
Raphel

(10) Patent No.: US 9,259,836 B2
(45) Date of Patent: Feb. 16, 2016

(54) TOOL BOX ASSEMBLY

(71) Applicant: Alex Raphel, Bridgewater, NJ (US)

(72) Inventor: Alex Raphel, Bridgewater, NJ (US)

( * ) Notice: Subject to any disclaimer, the term of this patent is extended or adjusted under 35 U.S.C. 154(b) by 0 days.

(21) Appl. No.: 14/295,407

(22) Filed: Jun. 4, 2014

(65) Prior Publication Data

US 2015/0352710 A1 Dec. 10, 2015

(51) Int. Cl.

| | |
|---|---|
| ***B25H 3/02*** | (2006.01) |
| ***B65D 25/28*** | (2006.01) |
| ***B65D 33/16*** | (2006.01) |
| ***B65D 43/16*** | (2006.01) |
| ***B65D 43/22*** | (2006.01) |
| ***B65D 63/10*** | (2006.01) |
| ***A47C 12/00*** | (2006.01) |

(52) U.S. Cl.

CPC *B25H 3/02* (2013.01); *A47C 12/00* (2013.01); *B65D 25/28* (2013.01); *B65D 33/16* (2013.01); *B65D 43/16* (2013.01); *B65D 43/22* (2013.01); *B65D 63/10* (2013.01); *B65D 2525/283* (2013.01)

(58) Field of Classification Search

CPC ..... A01K 97/22; A47C 12/00; B25H 3/02; B65D 25/28; B65D 33/16; B65D 43/16; B65D 43/22; B65D 63/10; B65D 2525/283; D06F 67/005

USPC ..... 206/372, 373; 312/235.1, 235.2, 237, 312/902

See application file for complete search history.

(56) References Cited

U.S. PATENT DOCUMENTS

| | | | | | |
|---|---|---|---|---|---|
| 4,366,998 | A | * | 1/1983 | Kaiser | 312/235.1 |
| 4,416,372 | A | * | 11/1983 | Polk | 206/372 |
| 4,545,414 | A | * | 10/1985 | Baum | 190/115 |
| 4,744,613 | A | | 5/1988 | Brantingham et al. | |
| 5,148,917 | A | * | 9/1992 | LeBrun | 206/372 |
| D355,828 | S | | 2/1995 | Dickinson et al. | |
| 5,505,303 | A | | 4/1996 | Sirman | |
| 5,680,932 | A | * | 10/1997 | Dickinson et al. | 206/372 |
| 5,697,669 | A | | 12/1997 | Yemini | |
| 5,882,097 | A | | 3/1999 | Kohagen et al. | |
| 6,488,346 | B2 | | 12/2002 | Chen | |
| 6,935,641 | B2 | | 8/2005 | Hahn | |
| 2003/0106821 | A1 | * | 6/2003 | Bar-Erez | 206/373 |
| 2007/0103892 | A1 | | 5/2007 | McDaniel et al. | |

FOREIGN PATENT DOCUMENTS

| | | |
|---|---|---|
| GB | 9312802 | 8/1993 |
| WO | WO2004101229 | 11/2004 |

* cited by examiner

*Primary Examiner* — Bryon Gehman

(57) ABSTRACT

A tool box assembly provides a tool box that can also be used as a step stool and a bench. The assembly includes a housing having a top, a bottom, and a perimeter wall coupled to and extending between the top and the bottom. The top defines a platform for a person to sit and stand upon. A first opening is positioned in the housing and provides access to an interior space of the housing for storing tools therein. A first door is coupled to the housing and is positionable to close the first opening.

16 Claims, 6 Drawing Sheets

TOOL BOX ASSEMBLY

BACKGROUND OF THE DISCLOSURE

Field of the Disclosure

The disclosure relates to tool box devices and more particularly pertains to a new tool box device for providing a tool box that can also be used as a step stool and a bench.

SUMMARY OF THE DISCLOSURE

An embodiment of the disclosure meets the needs presented above by generally comprising a housing having a top, a bottom, and a perimeter wall coupled to and extending between the top and the bottom. The top defines a platform for a person to sit and stand upon. A first opening is positioned in the housing and provides access to an interior space of the housing for storing tools therein. A first door is coupled to the housing and is positionable to close the first opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
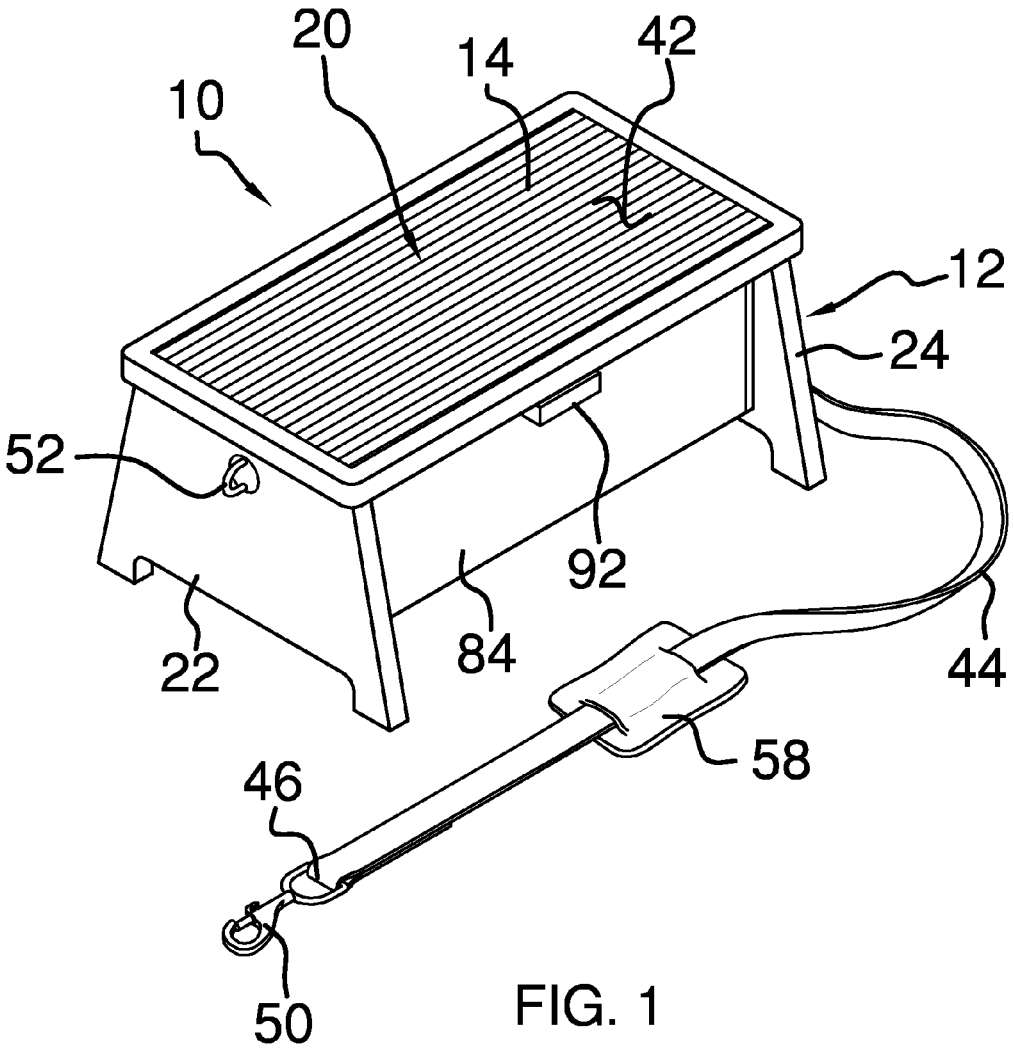
FIG. 1 is a top front side perspective view of a tool box assembly according to an embodiment of the disclosure.
Figure 2:
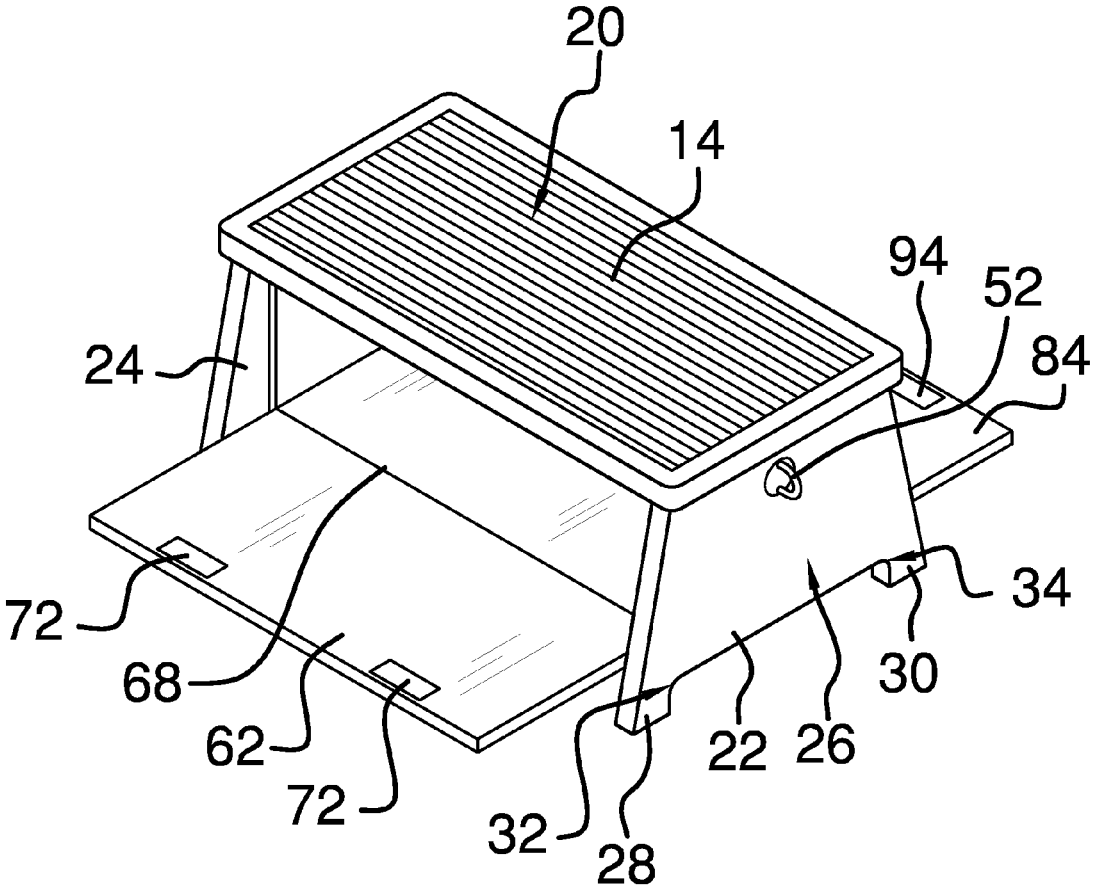
FIG. 2 is a top rear side perspective view of an embodiment of the disclosure.
Figure 3:
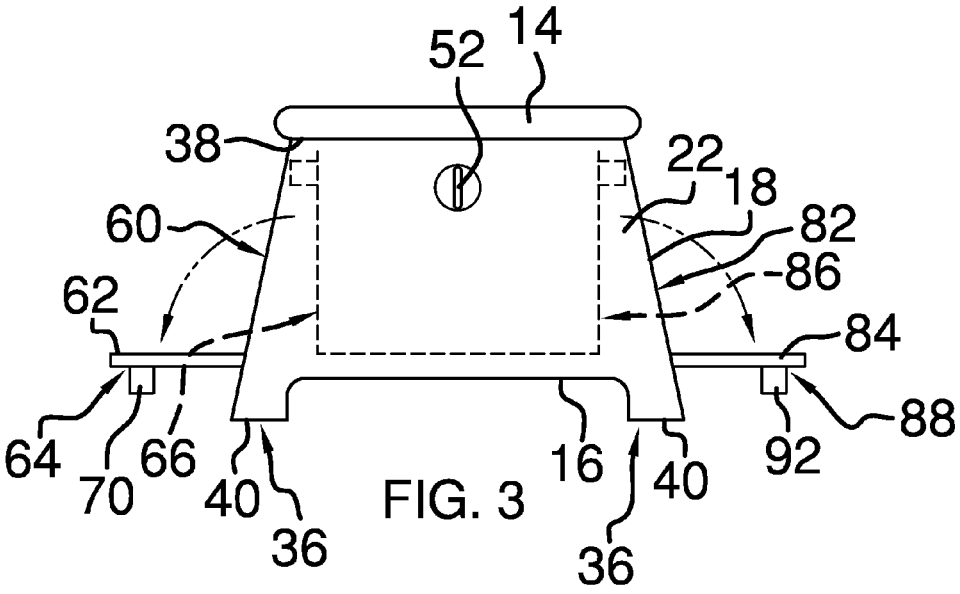
FIG. 3 is a side view of an embodiment of the disclosure.
Figure 4:
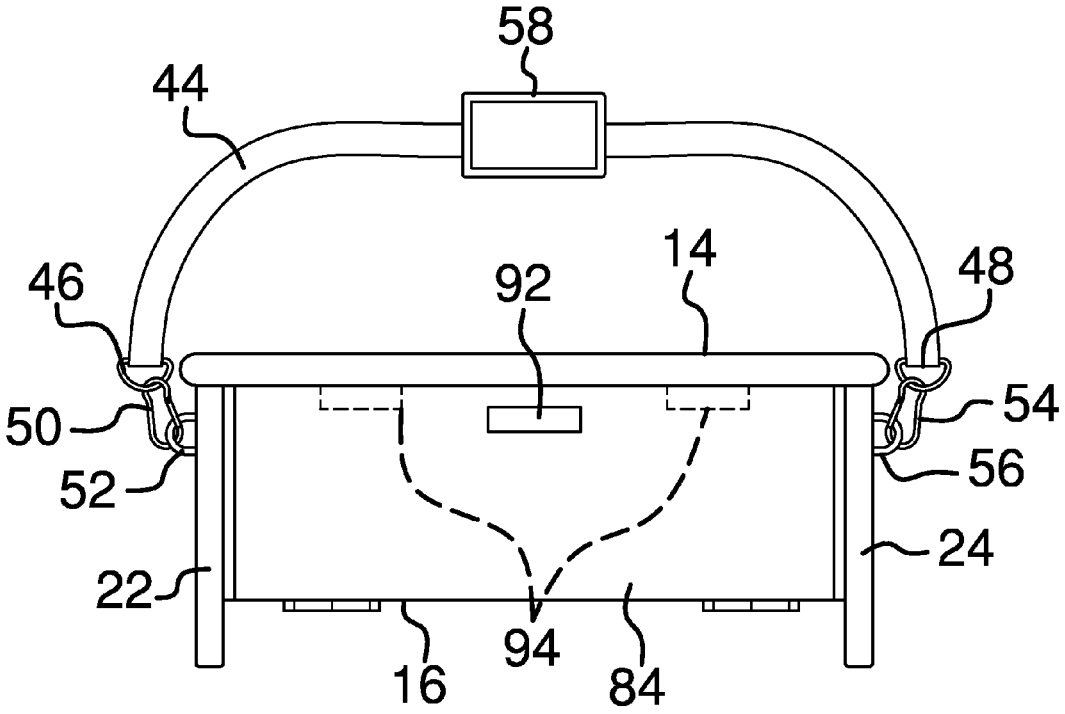
FIG. 4 is a front view of an embodiment of the disclosure.
Figure 5:
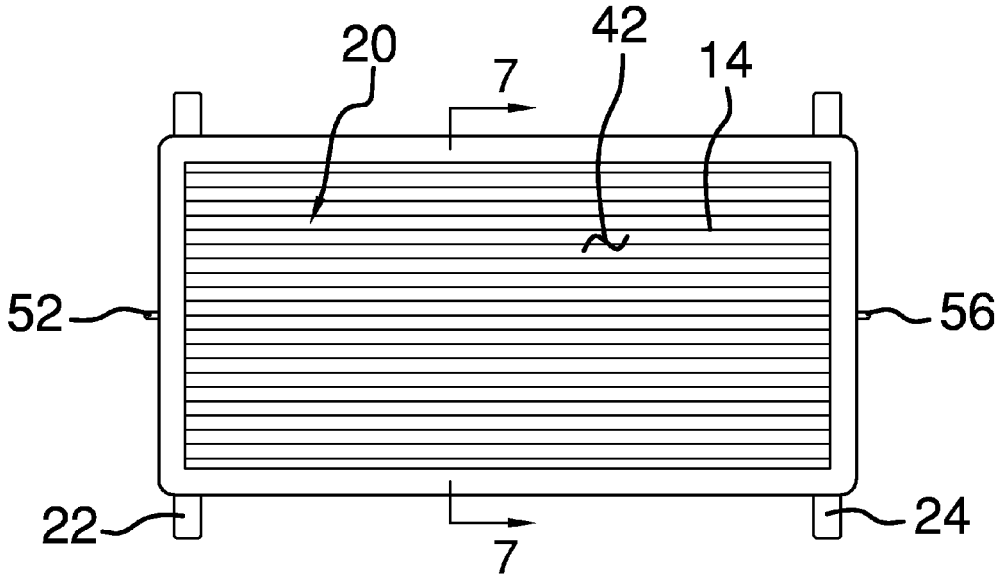
FIG. 5 is a top view of an embodiment of the disclosure.
Figure 6:
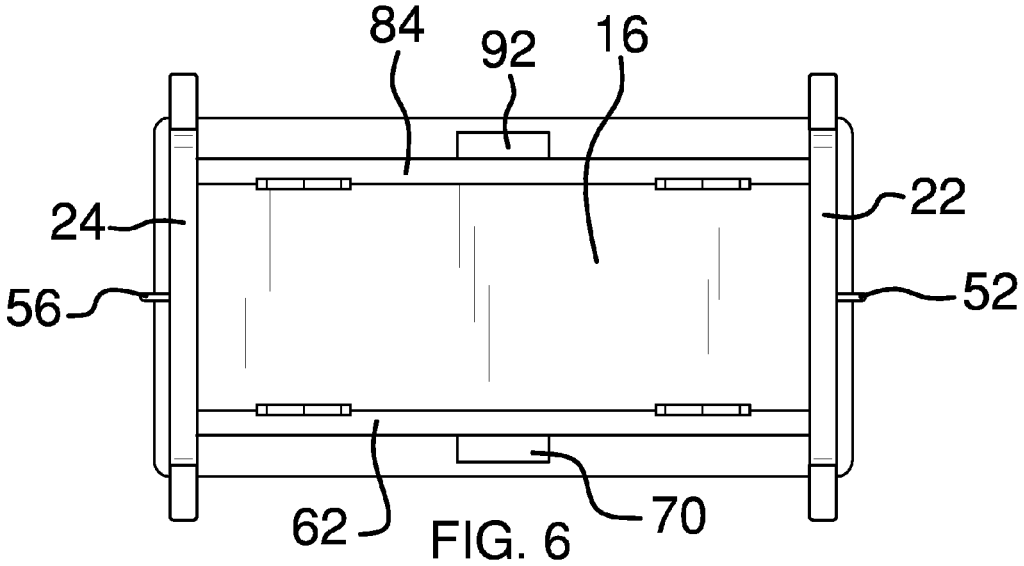
FIG. 6 is a bottom view of an embodiment of the disclosure.
Figure 7:
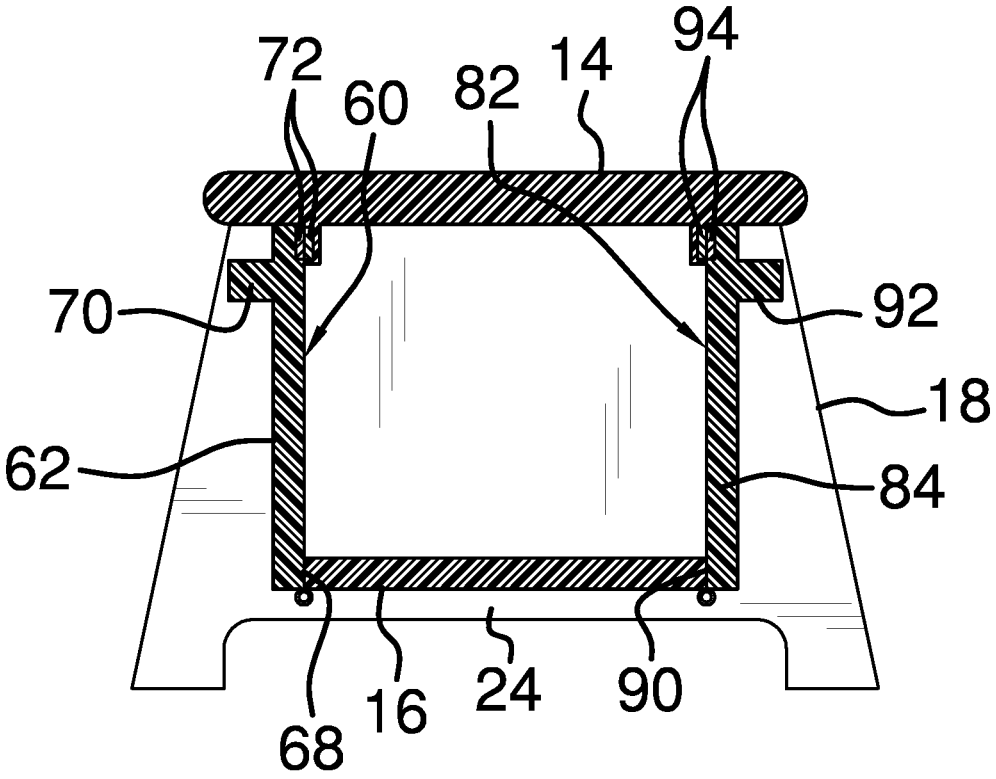
FIG. 7 is a cross-sectional view of an embodiment of the disclosure taken along line 7-7 of FIG. 5.
Figure 8:
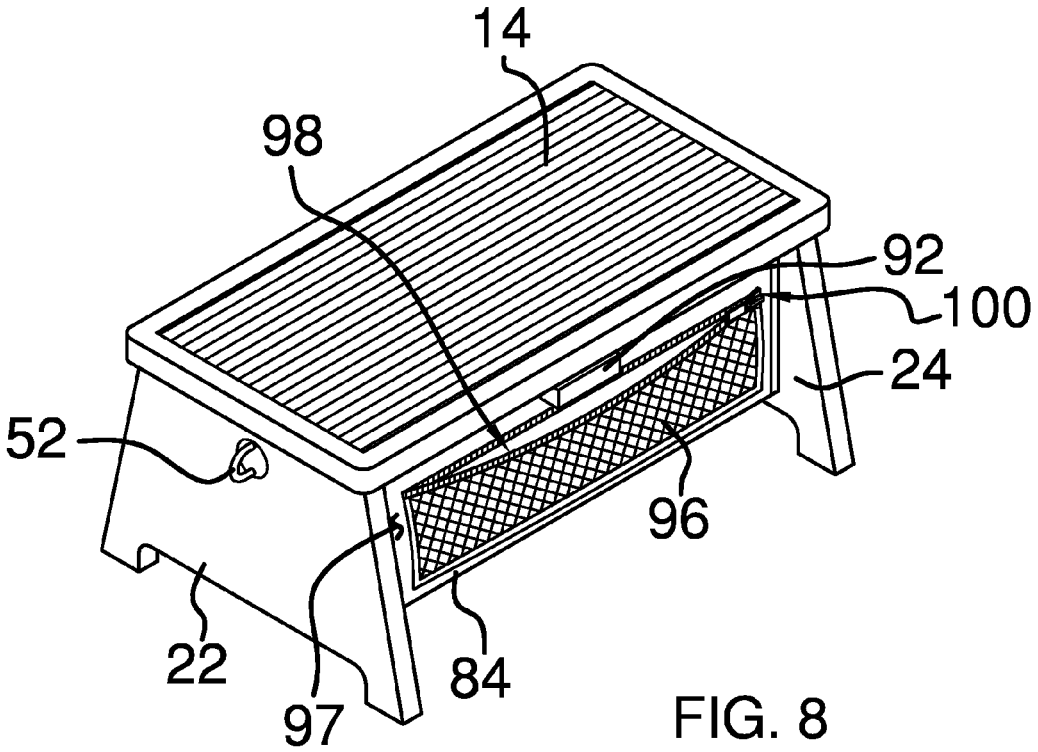
FIG. 8 is a top front side perspective view of an alternative embodiment of the disclosure.
Figure 9:
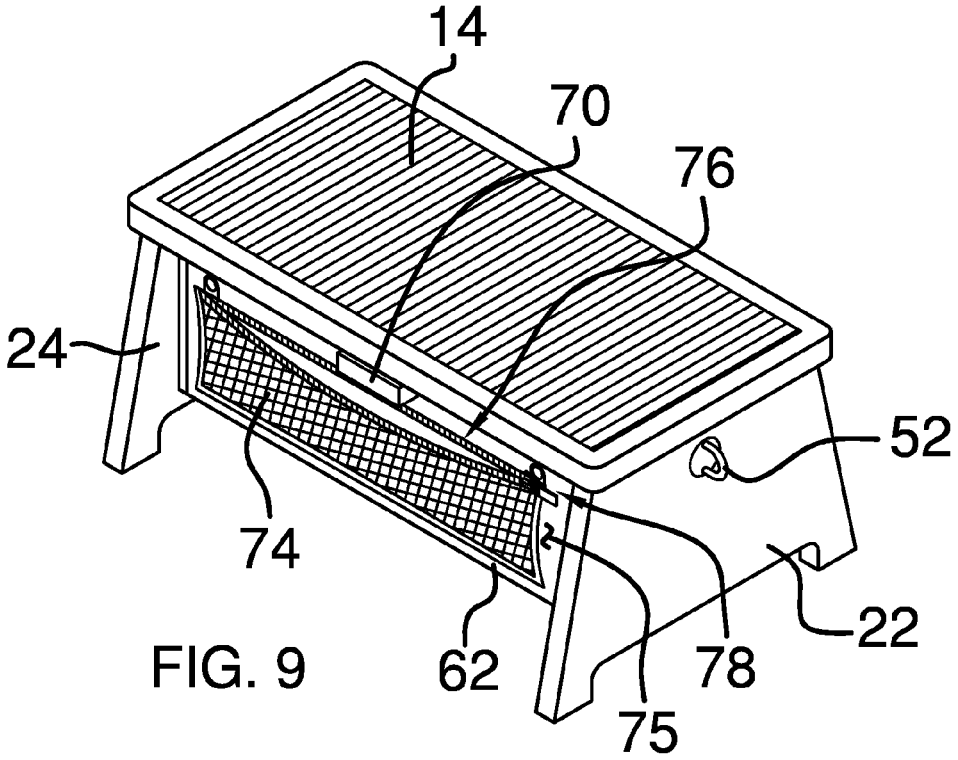
FIG. 9 is a top rear side perspective view of an alternative embodiment of the disclosure.

With reference now to the drawings, and in particular to FIGS. 1 through 9 thereof, a new tool box device embodying the principles and concepts of an embodiment of the disclosure and generally designated by the reference numeral 10 will be described.

As best illustrated in FIGS. 1 through 9, the tool box assembly 10 generally comprises a housing 12 having a top 14, a bottom 16, and a perimeter wall 18 coupled to and extending between the top 14 and the bottom 16. The top 14 defines a platform 20 for a person to sit and/or stand upon. The perimeter wall 18 includes a first lateral side 22 and a second lateral side 24. Each of the first 22 and second 24 lateral walls includes a medial section 26 and a pair of spaced projections 28, 30 integrally coupled to and extending downwardly from a respective outer edge 32, 34 of the associated medial section 26. Each of the projections 28, 30 extends below the bottom 16 of the housing 12 wherein the projections 28, 30 define legs 36 for supporting the housing 12 on a supporting surface. The legs 36 may also be telescopic in a generally conventional manner to adjust a distance between the platform 20 and the supporting surface. Each of the first 22 and second 24 lateral walls may taper outwardly from a top 38 of the associated medial section 26 to a bottom 40 of the associated leg 36. An upper surface 42 of the top 14 of the housing 12 may be ridged and comprised of a non-slip material, such as rubber or the like to provide traction when a person is standing upon the platform 20. The housing 12 is comprised of a rigid material, such as metal, plastic or the like.

A strap 44 is coupled to the housing 12 to facilitate carrying of the assembly 10. The strap 44 has a first end 46 and a second end 48. A first clip 50 is attached to the first end 46 of the strap 44. A first strap ring 52 is coupled to the first lateral side 22 of the perimeter wall 18. The first clip 50 is engageable with the first strap ring 52 for releasably securing the first end 46 of the strap 44 to the housing 12. A second clip 54 is attached to the second end 48 of the strap 44. A second strap ring 56 is coupled to the second lateral side 24 of the perimeter wall 18. The second clip 54 is engageable with the second strap ring 56 for releasably securing the second end 48 of the strap 44 to the housing 12. A cushion 58 may be attached to the strap 44 and positioned between the first end 46 and the second end 48 of the strap 44.

The housing 12 has a first opening 60 extending therein between the first 22 and second 24 lateral sides of the housing 12. The first opening 60 provides access to an interior space of the housing 12 wherein the interior space is configured for storing tools therein. A first door 62 is coupled to the housing 12 and is positionable to close the first opening 60. The first door 62 is pivotally coupled to the housing 12 for pivoting the first door 62 between a deployed position 64 and a storage position 66. The first door 62 is positioned to close the first opening 60 when the first door 62 is in the storage position 66. More particularly, the first door 62 may be pivotally coupled to a first edge 68 of the bottom 16 of the housing 12 such that the first door 62 is pivotable toward and away from the top 14 of the housing 12. A first handle 70 is coupled to the first door 62 to facilitate pivoting the first door 62 between the deployed 64 and storage 66 positions. A plurality of couplers 72 is attached to the first door 62 and to the top 14 of the housing 12 for releasably securing the first door 62 to the top 14 of the housing 12 when the first door 62 is in the storage position 66. Each coupler 72 may magnetically couple the first door 62 to the top 14 of the housing 12 or may comprise a latch or other conventional coupler.

A first pouch 74 is attached to an outer surface 75 of the first door 62. The first pouch 74 has a first access opening 76 extending therein providing access to an interior space of the first pouch 74. The first pouch 74 may be comprised of a netted material. A first closure 78 is attached to the first pouch 74 for closing the first access opening 76. The first closure 78 may comprise a zipper attached to and coextensive with the first access opening 76.

The housing 12 has a second opening 82 extending therein positioned opposite the first opening 60. The second opening 82 provides access to an interior space of the housing 12 wherein the interior space is configured for storing tools therein. A second door 84 is pivotally coupled to the housing 12 and is pivotable between a storage position 86 and a deployed position 88 wherein the second door 84 is positioned to close the second opening 82 when the second door 84 is in the storage position 86. More particularly, the second door 84 may be pivotally coupled to a second edge 90 of the bottom 16 of the housing 12 opposite the first edge 68 of the bottom 16 of the housing 12 such that the second door 84 is pivotable toward and away from the top 14 of the housing 12. A second handle 92 is coupled to the second door 84 to facilitate pivoting the second door 84 between the storage 86 and deployed 88 positions. At least one fastener 94 is attached to the second door 84 and to the top 14 of the housing 12 for releasably securing the second door 84 to the top 14 of the housing 12 when the second door 84 is in the storage position 86. Each fastener 94 may magnetically couple the second door 84 to the top 14 of the housing 12 or may comprise a latch or other conventional fastener.

A second pouch 96 is attached to an outer surface 97 of the second door 84. The second pouch 96 has a second access opening 98 extending therein providing access to an interior space of the second pouch 96. The second pouch 96 may be comprised of a netted material. A second closure 100 is attached to the second pouch 96 for closing the second access opening 98. The second closure 100 may comprise a zipper attached to and coextensive with the second access opening 98.

In use, the assembly 10 provides a combination tool box, step stool and seat. The user can open the first 62 and second 84 doors to access tools stored within the interior space of the housing 12. The user can stand or sit upon the platform 20 as desired. The first 62 and second 84 doors open downwardly away from the top 14 of the housing 12 to allow the user to access the interior space of the housing 12 while remaining seated on the platform 20. If desired, the assembly 10 can be carried using the strap 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tool box assembly comprising:

a housing having a top, a bottom, and a perimeter wall coupled to and extending between said top and said bottom, said top defining a platform for a person to sit and stand upon, said top being fixed relative to said perimeter wall;

said housing having a first opening extending therein, said first opening providing access to an interior space of said housing through a first lateral side of said housing wherein said interior space is configured for storing tools therein; and a first door, a bottom edge of said first door being pivotally coupled to a bottom surface of said bottom of said housing such that a top surface of said bottom is positioned above said first door when said first door is pivoted into a deployed position, said first door being pivotable between said deployed position and a storage position, said first door being positioned to close said first opening when said first door is in the storage position, said first door abutting a first edge of said bottom in said storage position such that said first door is perpendicular to said bottom in said storage position.

2. The assembly of claim 1, further comprising a first handle coupled to said first door to facilitate pivoting said first door between the deployed and storage positions.

3. The assembly of claim 1, further comprising at least one coupler attached to said first door and to said top of said housing for releasably securing said first door to said top of said housing when said first door is in the storage position.

4. The assembly of claim 3, further comprising each said coupler magnetically coupling said first door to said top of said housing.

5. The assembly of claim 1, further comprising an upper surface of said top of said housing being comprised of a non-slip material.

6. The assembly of claim 1, further comprising a strap coupled to said housing to facilitate carrying of said assembly.

7. The assembly of claim 6, further comprising a cushion attached to said strap and positioned between a first end and a second end of said strap.

8. The assembly of claim 6, further comprising:

said strap having a first end and a second end;

a first clip attached to said first end of said strap;

a first strap ring coupled to a first lateral side of said perimeter wall, said first clip being engageable with said first strap ring for releasably securing said first end of said strap to said housing;

a second clip attached to said second end of said strap; and a second strap ring coupled to a second lateral side of said perimeter wall, said second clip being engageable with said second strap ring for releasably securing said second end of said strap to said housing.

9. The assembly of claim 1, further comprising said perimeter wall including a first lateral wall and a second lateral wall, each of said first and second lateral walls including a medial section and a pair of spaced projections integrally coupled to and extending downwardly from a respective outer edge of said associated medial section, each of said projections extending below said bottom of said housing wherein said projections define legs for supporting said housing on a supporting surface.

10. The assembly of claim 9, further comprising each of said first and second lateral walls tapering outwardly from a top of said associated medial section to a bottom of said associated leg.

11. The assembly of claim 1, further comprising:

said housing having a second opening extending therein through a second lateral side of said housing and positioned opposite said first opening, said second opening providing access to said interior space of said housing; and a second door, a bottom edge of said second door being pivotally coupled to said bottom surface of said bottom of said housing such that said top surface of said bottom is positioned above said second door when said second door is pivoted into a deployed position, said second door being pivotable between said deployed position and a storage position, said second door being positioned to close said second opening when said second door is in the storage position, said second door abutting a second edge of said bottom opposite said first door in said storage position such that said second door is perpendicular to said bottom in said storage position.

12. The assembly of claim 11, further comprising a second handle coupled to said second door to facilitate pivoting said second door between the storage and deployed positions.

13. The assembly of claim 11, further comprising at least one fastener attached to said second door and to said top of said housing for releasably securing said second door to said top of said housing when said second door is in the storage position.

14. The assembly of claim 1, further comprising said first door having a first pouch attached to an outer surface thereof, said first pouch having a first access opening extending therein providing access to an interior space of said first pouch.

15. The assembly of claim 14, further comprising a first closure attached to said first pouch for closing said first access opening.

16. A tool box assembly comprising:

a housing having a top, a bottom, and a perimeter wall coupled to and extending between said top and said bottom, said top being fixed relative to said perimeter wall, said top defining a platform for a person to sit and stand upon, said perimeter wall including a first lateral side and a second lateral side, each of said first and second lateral walls including a medial section and a pair of spaced projections integrally coupled to and extending downwardly from a respective outer edge of said associated medial section, each of said projections extending below said bottom of said housing wherein said projections define legs for supporting said housing on a supporting surface, each of said first and second lateral walls tapering outwardly from a top of said associated medial section to a bottom of said associated leg, an upper surface of said top of said housing being ridged and comprised of a non-slip material;

a strap coupled to said housing to facilitate carrying of said assembly, said strap having a first end and a second end;

a first clip attached to said first end of said strap;

a first strap ring coupled to said first lateral side of said perimeter wall, said first clip being engageable with said first strap ring for releasably securing said first end of said strap to said housing;

a second clip attached to said second end of said strap;

a second strap ring coupled to said second lateral side of said perimeter wall, said second clip being engageable with said second strap ring for releasably securing said second end of said strap to said housing;

a cushion attached to said strap and positioned between said first end and said second end of said strap;

said housing having a first opening positioned therein extending through a first lateral side of said housing, said first opening providing access to an interior space of said housing wherein said interior space is configured for storing tools therein;

a first door, a bottom edge of said first door being pivotally coupled to a bottom surface of said bottom of said housing such that a top surface of said bottom is positioned above said first door when said first door is pivoted into a deployed position, said first door being pivotable between said deployed position and a storage position, said first door being positioned to close said first opening when said first door is in the storage position, said first door abutting a first edge of said bottom in said storage position such that said first door is perpendicular to said bottom in said storage position;

a first handle coupled to said first door to facilitate pivoting said first door between the deployed and storage positions;

a plurality of couplers attached to said first door and to said top of said housing for releasably securing said first door to said top of said housing when said first door is in the storage position, each said coupler magnetically coupling said first door to said top of said housing;

a first pouch attached to an outer surface of said first door, said first pouch having a first access opening extending therein providing access to an interior space of said first pouch, said first pouch being comprised of a netted material;

a first closure attached to said first pouch for closing said first access opening, said first closure comprising a zipper attached to and coextensive with said first access opening;

said housing having a second opening extending therein through a second lateral side of said housing, said second opening providing access to said interior space of said housing;

a second door, a bottom edge of said second door being pivotally coupled to said bottom surface of said bottom of said housing such that said top surface of said bottom is positioned above said second door when said second door is pivoted into a deployed position, said second door being pivotable between said deployed position and a storage position, said second door being positioned to close said second opening when said second door is in the storage position, said second door abutting a second edge of said bottom opposite said first door in said storage position such that said second door is perpendicular to said bottom in said storage position;

a second handle coupled to said second door to facilitate pivoting said second door between the storage and deployed positions;

at least one fastener attached to said second door and to said top of said housing for releasably securing said second door to said top of said housing when said second door is in the storage position, each said fastener magnetically coupling said second door to said top of said housing;

a second pouch attached to an outer surface of said second door, said second pouch having a second access opening extending therein providing access to an interior space of said second pouch, said second pouch being comprised of a netted material; and a second closure attached to said second pouch for closing said second access opening, said second closure comprising a zipper attached to and coextensive with said second access opening.

* * * * *